US010006475B2

(12) United States Patent
Jurczyk

(10) Patent No.: US 10,006,475 B2
(45) Date of Patent: Jun. 26, 2018

(54) ACTUATOR

(71) Applicant: LB Bentley Limited, Stroud, Gloucestershire (GB)

(72) Inventor: Krzysztof Jurczyk, Stroud (GB)

(73) Assignee: LB Bentley Limited, Gloucestershire (GB)

( * ) Notice: Subject to any disclaimer, the term of this patent is extended or adjusted under 35 U.S.C. 154(b) by 316 days.

(21) Appl. No.: 14/901,242

(22) PCT Filed: Jul. 8, 2014

(86) PCT No.: PCT/GB2014/052074
§ 371 (c)(1),
(2) Date: Dec. 28, 2015

(87) PCT Pub. No.: WO2015/008034
PCT Pub. Date: Jan. 22, 2015

(65) Prior Publication Data

US 2016/0369823 A1 Dec. 22, 2016

(30) Foreign Application Priority Data

Jul. 18, 2013 (GB) ..... 1312869.9

(51) Int. Cl.
*F15B 15/06* (2006.01)
*F15B 15/20* (2006.01)

(52) U.S. Cl.
CPC ..... *F15B 15/06* (2013.01); *F15B 15/061* (2013.01); *F15B 2015/206* (2013.01)

(58) Field of Classification Search
CPC ..... F15B 15/06; F15B 15/061; F16D 11/10; F16D 11/00; F16D 2023/123; F16D 21/06
See application file for complete search history.

(56) References Cited

U.S. PATENT DOCUMENTS 2,818,743 A * 1/1958 Zatsky ..... F16H 25/04 74/1 R
4,089,229 A 5/1978 Geraci
(Continued)

FOREIGN PATENT DOCUMENTS

EP 1936208 6/2008
GB 355022 8/1931
(Continued)

OTHER PUBLICATIONS

International Search Report for PCT/GB2014/052074 dated Sep. 19, 2014.
Search Report for GB1312869.9 dated Jan. 16, 2014.

*Primary Examiner* — Stacey A Fluhart
(74) *Attorney, Agent, or Firm* — Andrus Intellectual Property Law, LLP

(57) ABSTRACT

An actuator comprises an axially moveable piston coupled to a drive member such that axial movement of the piston 16 drives the drive member for angular movement, the drive member being coupled via a clutch to an output member, the output member further being coupled by way of a cam arrangement with an override actuator, the cam arrangement being operable such that initial angular movement of the override actuator relative to the output member can drive the output member for axial movement, disengaging the clutch, further movement of the override actuator driving the output member for angular movement.

9 Claims, 3 Drawing Sheets

(56) References Cited

U.S. PATENT DOCUMENTS

| | | | | |
|---|---|---|---|---|
| 4,176,687 | A * | 12/1979 | Ensign | F16K 11/044<br>137/625.27 |
| 6,550,594 | B1 * | 4/2003 | Peura | F16D 41/10<br>192/35 |
| 2002/0065171 | A1 * | 5/2002 | Raber | F16D 21/06<br>477/175 |

FOREIGN PATENT DOCUMENTS

| | | |
|---|---|---|
| JP | 2003175440 | 6/2003 |
| JP | 2003194015 | 7/2003 |
| WO | 2003085815 | 10/2003 |
| WO | 2004090403 | 10/2004 |

* cited by examiner

ACTUATOR

CROSS REFERENCE TO RELATED APPLICATIONS

The present application is the U.S. national stage application of International Application PCT/GB2014/052074, filed Jul. 8, 2014, which international application was published on Jan. 22, 2015, as International Publication WO2015/008034. The International Application claims priority of British Patent Application 1312869.9, filed Jul. 18, 2013, the contents of which are incorporated herein by reference in their entireties.

This invention relates to an actuator, and in particular to an actuator suitable for use in adjusting the position of a valve. The actuator is particularly intended for use in subsea applications, although may also be used in other applications, both in controlling the operation of valves and with other devices.

BACKGROUND

One form of valve in common use in subsea applications is a rotary gate valve. Such a valve has a valve member engageable with a seat to control fluid flow between a pair of ports thereof. The valve may, if desired, control fluid flow in both directions between the ports. The valve member is angularly movable between a closed position in which fluid flow between the ports is not permitted, and an open position in which such flow may take place. Typically, the valve member is moved through an angle of approximately 90° in moving between the open and closed positions.

It is often desirable to be able to drive the valve between its open and closed positions from a remote location. One form of actuator used to drive such a valve for movement is a hydraulically operated actuator. A known form of hydraulic actuator comprises a piston moveable under the application of fluid under high pressure thereto between first and second positions. The piston carries one or more pins which extend into angled slots formed in a drive member such that axial movement of the piston causes angular movement of the drive member. By connection of the drive member to the valve member of a valve, it will be appreciated that adjustment of the position of the valve can be achieved through appropriate control of the fluid pressures applied to the piston.

The piston is typically spring biased towards a known position, for example it may be biased towards a valve closed position so that, in the absence of the application of pressure thereto, the valve will be closed, the valve only occupying its open position when hydraulic fluid is applied to the piston, the valve thus taking the form of a fail safe closed or FSC valve.

In the event of a failure within the control system or actuator, it may be necessary to manually adjust the valve position. Where the valve is located in a subsea location, this will typically be undertaken by a diver or ROV. In one known form of actuator, such manual adjustment first requires the diver or ROV to apply an axial load to a manual override actuator to disengage a clutch provided between the drive member and the valve member, and for the diver or ROV to then rotate the manual override actuator to drive the valve member to the desired position. The application of the axial load is an undesirable complication for a diver or ROV to achieve. Accordingly, such manual override is undesirable. Furthermore, there is insufficient visual indication of whether or not the manual override is engaged.

SUMMARY

It is an object of the invention to provide an actuator in which at least some of the disadvantages with the arrangement outlined hereinbefore are overcome or are of reduced effect.

According to the present invention there is provided an actuator comprising an axially moveable piston coupled to a drive member such that axial movement of the piston drives the drive member for angular movement, the drive member being coupled via a clutch to an output member, the output member further being coupled by way of a cam arrangement with an override actuator, the cam arrangement being operable such that initial angular movement of the override actuator relative to the output member can drive the output member for axial movement, disengaging the clutch, further movement of the override actuator driving the output member for angular movement.

It will be appreciated that such an arrangement is advantageous in that, in use, to operate the manual override arrangement, the manual override actuator need only be moved angularly. No axial movement thereof is required. Accordingly, use thereof by a diver or ROV, or in other situations, is simplified.

The cam arrangement conveniently comprises a pin carried by the output member, the pin being engageable with a cam surface of a sleeve coupled to or forming part of the override actuator. The cam surface is preferably defined by an opening formed in the sleeve. The opening is preferably of generally triangular shape.

The output member is preferably biased, for example, by a spring, towards an axial position in which the clutch is engaged, in which the pin of the cam arrangement is located at an apex of the cam surface. It will be appreciated that in this position, the application of fluid under pressure to the piston can be used to drive the output member for angular movement. Should manual override be required, then angular movement of the override actuator in either direction will, initially, result in axial movement of the output member, disengaging this clutch, and subsequently in angular movement of the output member, adjusting the position of the associated valve.

The pin of the cam arrangement conveniently extends into a pocket formed in an indicator sleeve to which an indicator member is mounted. In use, angular movement of the output member, and hence of the valve, whether caused by movement of the piston or by adjustment of the override actuator, drives the indicator sleeve and indicator member for movement, providing a visual indication of the valve position at all times.

A stop arrangement is preferably provided to limit angular movement of the output member when the clutch is disengaged. Conveniently the stop arrangement comprises a stop pin arranged to ride within a pocket formed within the indicator sleeve, limiting the angle through which the indicator sleeve, and hence the output member, can travel.

BRIEF DESCRIPTION OF THE DRAWINGS

The invention will further be described, by way of example, with reference to the accompanying drawings, in which.

DETAILED DESCRIPTION OF THE DRAWINGS

Figure 3:
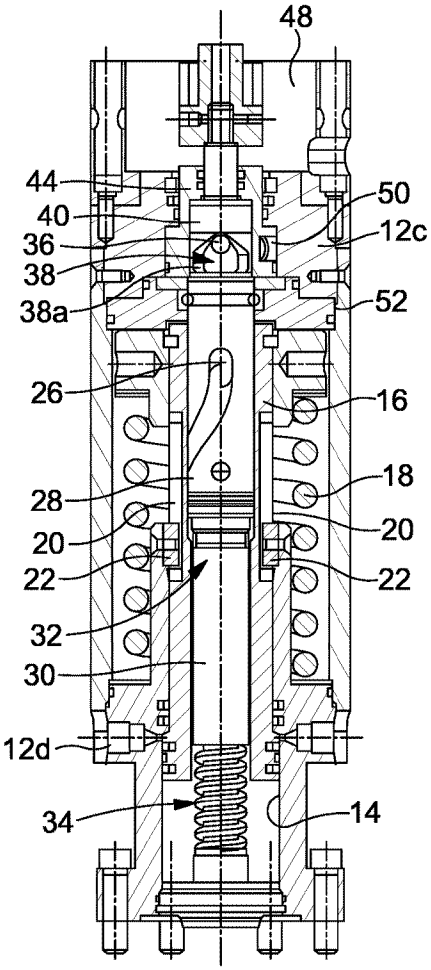
FIGS. 2 and 3 are part sectional views illustrating the actuator of FIG. 1.
Figure 2:
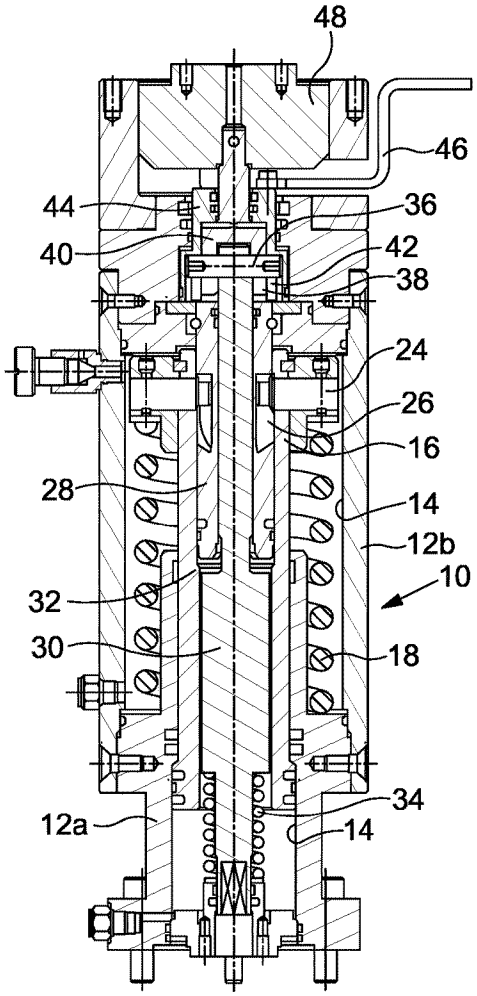
Figure 1:
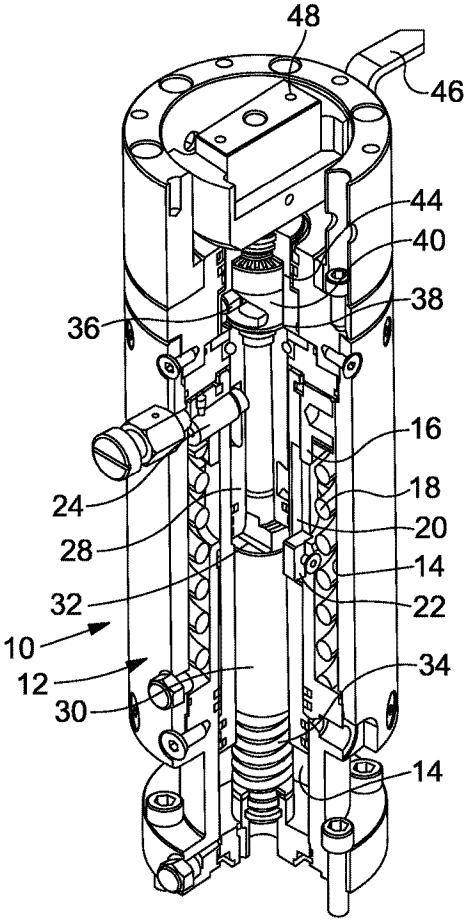
FIG. 1 is a perspective view, partly in section, illustrating an actuator in accordance with one embodiment of the invention.

Referring to the accompanying drawings, an actuator 10 is illustrated for use in driving an associated rotary valve for movement. The nature of the valve with which the actuator is used is not of importance to the invention and so the valve is not illustrated in the accompanying drawings. By way of example only, the valve may take the form of a gate valve having a valve member which is rotatable or moveable through an angle of approximately 90° between its fully open and fully closed positions. It will be appreciated, however, that this is merely one example of a valve with which the actuator of the invention may be used. The actuator may be used with a range of other valves, or indeed in controlling the operation of other forms of device.

The actuator 10 comprises a housing part 12*a* defining a cylinder 14 within which a piston 16 is axially moveable. A spring 18 is provided within a chamber defined by a second housing part 12*b*, the spring 18 being operable to bias the piston 16 in an upward direction, in the orientation illustrated. The piston 16 is provided, in its outer surface, with a groove or slot 20 within which a key 22 mounted to the housing 12*a* rides so as to constrain the piston 16 against angular movement whilst permitting axial movement thereof.

The part of the housing 12*b* containing the spring 18 is pressure balanced to the external hyberbaric pressure, for example by way of a sea chest, and a pressure chamber 12*c* (see FIG. 4) defined between the piston 16 and the cylinder 14 communicates with an inlet port 12*d* whereby hydraulic fluid under pressure can be supplied to the pressure chamber 12*c*.

It will be appreciated that the supply of hydraulic fluid under pressure to the pressure chamber 12*c* urges the piston 16 in the downwards direction, in the orientation illustrated, against the action of the spring 18. Upon connecting the pressure chamber to a lower pressure, the piston 16 returns under the action of the spring 18.

The piston 16 carries a pair of radially extending, inwardly projecting pins 24, the inner ends of which engage within generally helically shaped slots or grooves 26 formed in a drive member 28. The drive member 28 is constrained against axial movement, but is free to move angularly, and it will be appreciated that upon axial movement of the piston 16, the cooperation of the pins 24 within the slots 26 results in the drive member 28 being driven for angular movement. The shape of the slots 26, and angular extent thereof, determines the pattern of movement of the drive member 28, the range of angular movement thereof, and the output torque applied as a result of the application of hydraulic fluid to the actuator.

The lower end of the drive member 28 is coupled to an axially extending output member 30 by a clutch arrangement 32. The clutch arrangement takes the form of a dog clutch, comprising a diametrically extending slot 32*a* formed in the lower end of the drive member 28 arranged to receive a correspondingly shaped region 32*b* of the output member 30. In use, when the clutch is engaged, angular movement of the drive member 28 is transmitted by the clutch arrangement 32 to the output member 30. Axial movement of the output member 30 disengages the clutch arrangement 32, allowing angular movement of the output member 30 independently of the drive member 28. A spring 34 applies a load to the output member 30, biasing it towards an axial position in which the clutch arrangement 32 is engaged.

The drive member 28 is of hollow form, the output member 30 extending completely through the drive member 28. The upper end of the output member 30 is provided with a diametrically extending pin 36 which projects through a cam opening 38 formed in a cam sleeve 40 and into pockets 42 formed in an indicator sleeve 44. The pockets 42 take the form of slots extending in the axial direction of the actuator, but shaped so as to substantially prevent relative angular movement between the output member 30 and the indicator sleeve 44. Accordingly, it will be appreciated that the indicator sleeve 44 and output member 30 will always occupy the same angular position as one another, the pockets 42 accommodating limited axial movement of the output member 30. An indicator member 46 is secured to the indicator sleeve 44 to provide a visual indication of the orientation of the indicator sleeve 44, and hence of the output member 30 and of a valve member secured thereto, in use.

The cam sleeve 40 is secured to an override actuator paddle 48 arranged such that angular movement of the paddle 48 drives the cam sleeve 40 for angular movement. The angular movement of the cam sleeve 40, and resulting cooperation between the cam surface 38*a* of the cam opening 38 and the pin 36 is able to drive the output member 30 for both axial and angular movement as set out below.

The outer surface of the indicator sleeve 44 is provided with an arcuate pocket 50 within which an end of a stop pin 52 secured to the adjacent part 12*c* of the actuator housing 12 rides. It will be appreciated that the cooperation of the end of the pin 52 within the pocket 50 limits angular movement of the indicator sleeve 44, and hence limits angular movement of the output member 30 and associated valve member. The stop arrangement so provided enables a valve or other device controlled using the actuator to be accurately positioned in its open or closed positions when the manual override is in use.

In normal use, when the actuator 10 and associated valve are operating normally and there is no requirement for manual intervention, the actuator 10 is operated by controlling the pressure of the hydraulic fluid applied to the pressure chamber 12*c* to control the position of the piston 16. As outlined hereinbefore, the axial position of the piston 16 governs the angular position of the drive member 28, and as the drive member 28 is usually coupled to the output member 30 by way of the engaged clutch 32, the pressure applied to the chamber 12*c* controls the angular position of the output member 30 and a valve member associated therewith. Increasing the applied pressure is used to drive the piston 16 towards its lowermost extreme position, opening the associated valve. Relieving the pressure within the chamber 12*c* allows the piston 16 to move towards its opposite extreme position under the action of the spring 18, closing the valve. The arrangement is thus fail safe closed. If desired, it could be arranged to take a failsafe open form.

Figure 4:
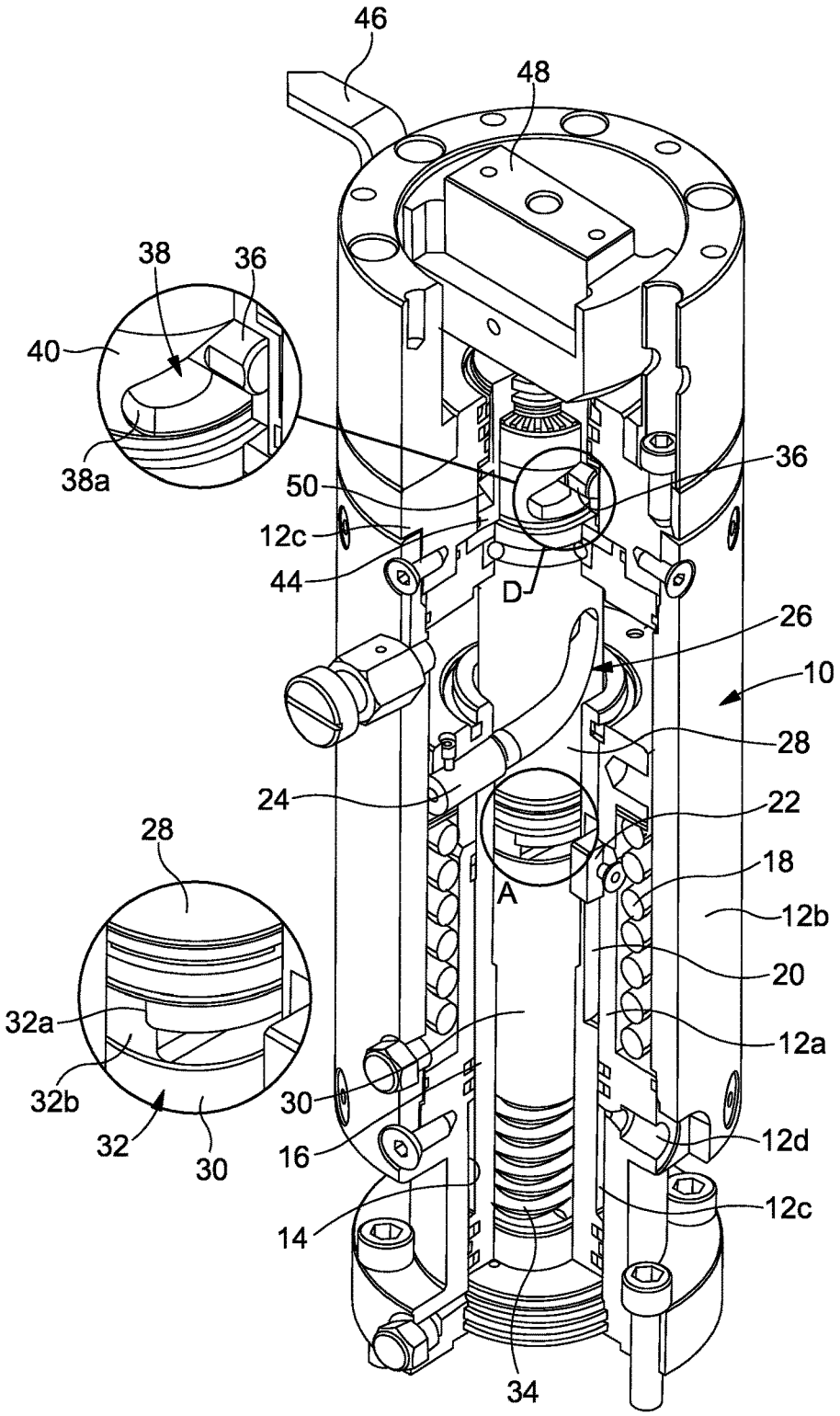
FIG. 4 is a view similar to FIG. 1 illustrating the actuator in an alternative operating position.

In this mode of operation, as best shown in FIG. 4, the paddle 48 and indicator member 46 are aligned with one another, thereby providing an indication that the clutch is engaged and that the actuator 10 is operating in its normal operating mode.

Figure 5:
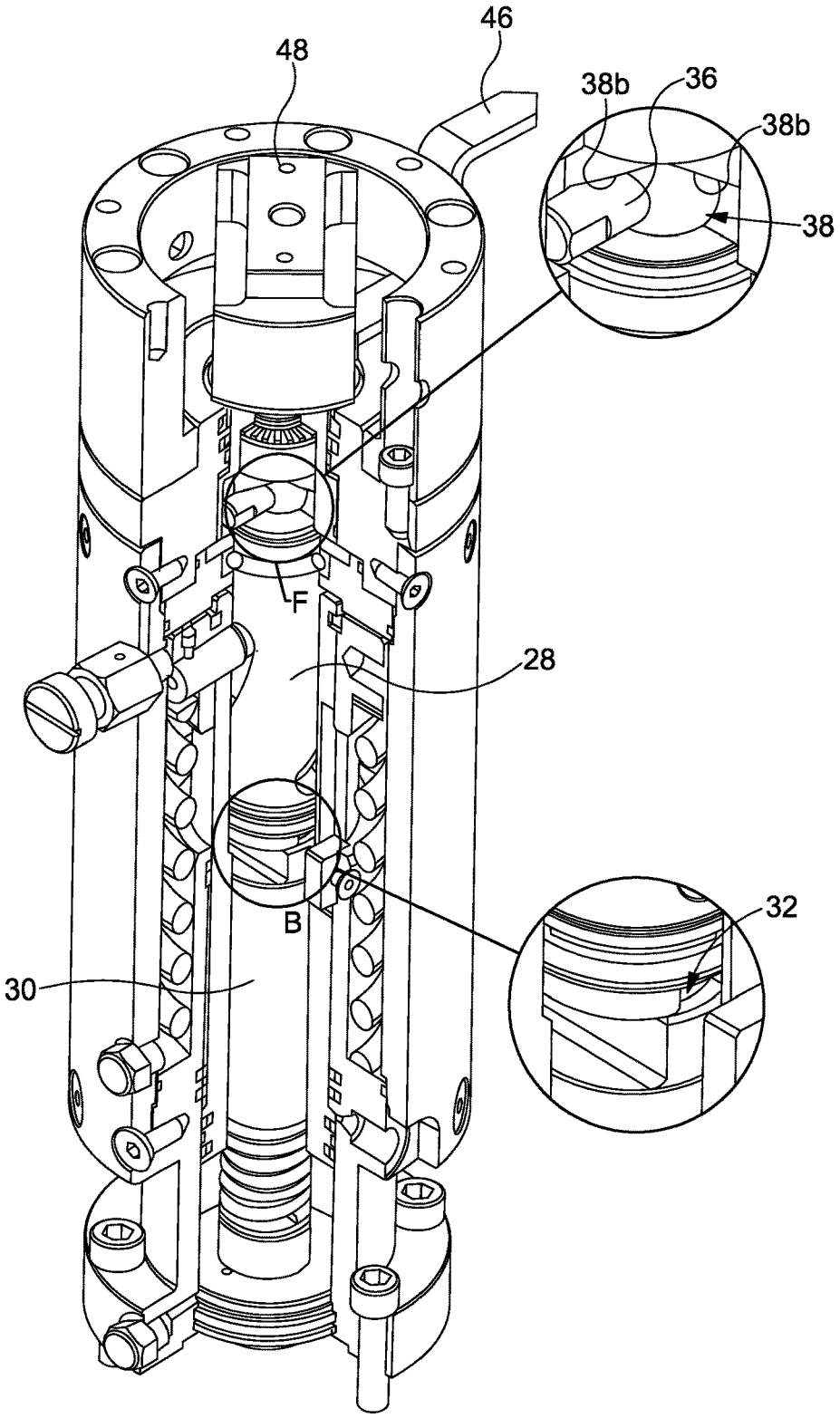
FIG. 5 is a view illustrating the operation of the manual override function of the actuator.

In the event of a failure or other need to manually operate or adjust the valve, the paddle 48 is moved angularly relative to the remainder of the actuator 10, as shown in FIG. 5. The angular movement of the paddle 48 drives the cam sleeve 40 for angular movement, causing the pin 36 to bear against and ride along one or other of the angled or sloped parts 38*b* of the cam surface 38*a*, depending upon the direction of angular movement of the paddle 48. This movement forces the output member 30 to which the pin 36 is mounted to move axially. The axial movement of the output member 30, against the action of the spring 34, results in the output member 30 moving to a position in which the clutch arrangement 32 is disengaged. The axial movement of the output member 30 required to achieve disengagement of the clutch arrangement is achieved after movement of the paddle 48 through an angle of approximately 45°, at which point the pin 36 is bearing against a side of the cam surface 38*a*. It will be appreciated that friction within the valve and actuator, and the drive member 28, serve to hold the output member 30 against angular movement during this operation.

Once the clutch arrangement is disengaged, continued movement of the paddle 48 is transmitted via the engagement of the cam sleeve 40 and the pin 36 to the output member 30, driving the output member 30 and associated valve member for angular movement until the desired position is reached. Typically, this would be one of the stop positions defined by the operation of the stop arrangement.

It will be appreciated that throughout the movement of the paddle 48, the indicator member 46 continues to provide an accurate indicator of the angular position of the output member 30 and associated valve member.

As shown in FIG. 5, during this operating mode, the paddle 48 and indicator member 46 are no longer aligned, providing a visual indication that the manual override is engaged.

As, during this movement of the output member 30, the clutch arrangement 32 is disengaged, it will be appreciated that the drive member 28 and piston 16 can remain stationary, if required. Angular movement of the output member 30 is limited by the cooperation of the stop pin 52 within the arcuate slot 50.

When it is desired to reset the actuator 10 for normal operation, the operator can either rotate the output member 30 in the reverse direction by appropriate movement of the paddle 48, to move the output member 30 to a position at which the clutch arrangement 32 can reengage, the spring 34 then driving the output member 30 axially to reengage the clutch once the paddle 48 is released. The paddle 48 will, or course, have to be moved through an angle of 90° before movement of the output member 30 in the reverse direction commences. Alternatively, by appropriate control of the pressure applied to the chamber 12*c*, the drive member 28 can be moved angularly until it reaches the angular orientation in which the clutch arrangement 32 can reengage, at which point the spring biasing of the output member 30 causes axial movement thereof, reengaging the clutch arrangement 32. The axial movement of the output member 30 and cooperation between the pin 36 and cam surface 38*a* also drives the cam sleeve 40 and paddle 48 to the position in which the paddle 48 and indicator member 46 are aligned, providing a visual indication that the manual override has been reset and that normal operation of the actuator is resumed.

It will be appreciated that the actuator 10 described hereinbefore is advantageous in that there is no need to apply an axially directed load to the paddle 48 in order to operate the actuator 10 in a manual override mode. The actuator is thus ideally suited for use in subsea operations in which a diver or ROV may have to be deployed to operate the actuator in this mode. The indicator member 46 provides an accurate indication of the valve position at all times, regardless of the mode of operation. The alignment or misalignment of the paddle relative to the indicator member provides a clear visual indication of whether or not the clutch is engaged, and hence of the operating mode of the actuator. Where a diver or ROV is used to operate the actuator in a manual override condition, subsequent resetting of the actuator can be achieved under hydraulic control, thus there is no need for a diver or ROV to be deployed to reset the actuator. As a clear visual indication is given that the clutch is engaged, a remote operator can be confident that the resetting operation has been completed successfully.

It will be appreciated that the description hereinbefore is of one form of actuator in accordance with the invention and that a wide range of modifications and alterations may be made thereto without departing from the scope of the invention as defined by the appended claims.

The invention claimed is:

1. An actuator comprising an axially moveable piston coupled to a drive member such that axial movement of the piston drives the drive member for angular movement, the drive member being coupled via a clutch to an output member, the output member further being coupled by way of a cam arrangement with an override actuator, the cam arrangement being operable such that initial angular movement of the override actuator relative to the output member can drive the output member for axial movement, disengaging the clutch, further movement of the override actuator driving the output member for angular movement, wherein the cam arrangement comprises a pin carried by the output member, the pin being engageable with a cam surface of a sleeve coupled to or forming part of the override actuator.

2. An actuator according to claim 1, wherein the cam surface is defined by an opening formed in the sleeve.

3. An actuator according to claim 2, wherein the opening is symmetrical.

4. An actuator according to claim 2, wherein the opening is of generally triangular shape.

5. An actuator according to claim 1, wherein the output member is biased towards an axial position in which the clutch is engaged.

6. An actuator according to claim 1, wherein the output member is biased towards an axial position in which the clutch is engaged, and in which when the clutch is engaged the pin of the cam arrangement is located at an apex of the cam surface.

7. An actuator according to claim 1, wherein the pin of the cam arrangement extends into a pocket formed in an indicator sleeve to which an indicator member is mounted.

8. An actuator according to claim 7, further comprising a stop arrangement to limit angular movement of the output member when the clutch is disengaged, and wherein the stop arrangement comprises a stop pin arranged to ride within a pocket formed within the indicator sleeve, limiting the angle through which the indicator sleeve, and hence the output member, can travel.

9. An actuator according to claim 1, further comprising a stop arrangement to limit angular movement of the output member when the clutch is disengaged.

* * * * *